United States Patent [19]

Fontanaud

[11] 4,196,819

[45] Apr. 8, 1980

[54] REDUCER-CARRYING CAP

[76] Inventor: Robert Fontanaud, 5 ave. Amiral Courbet La Haquinière, 91190 Gif-sur-Yvette, France

[21] Appl. No.: 970,576

[22] Filed: Dec. 18, 1978

[30] Foreign Application Priority Data

Jul. 6, 1978 [FR] France ..... 78 20214

[51] Int. Cl.[2] ..... B65D 41/32

[52] U.S. Cl. ..... 215/253; 222/568; 222/569

[58] Field of Search ..... 215/253, 250, 341, 307; 222/541, 566, 567, 568, 569, 570, 564

[56] References Cited

U.S. PATENT DOCUMENTS

| | | | |
|---|---|---|---|
| 2,715,480 | 8/1955 | Livingstone | 222/268 X |
| 3,135,441 | 6/1964 | Wise et al. | 222/569 X |
| 3,186,606 | 6/1965 | Williams | 222/568 X |
| 4,111,325 | 9/1978 | Bellamy | 215/253 X |

*Primary Examiner*—George T. Hall

[57] ABSTRACT

A reducer-carrying cap, cover, applicator spout or other part, comprising a cap member open at the top which is moulded in one piece with the reducer, cover, applicator spout or other part, the lid plate of the cap being moulded simultaneously with a hinge operated at 180° or alternatively, the lid plate is moulded so as to be subsequently fitted to the cap member, this may be effected by ultrasonic welding.

9 Claims, 12 Drawing Figures

Fig:4
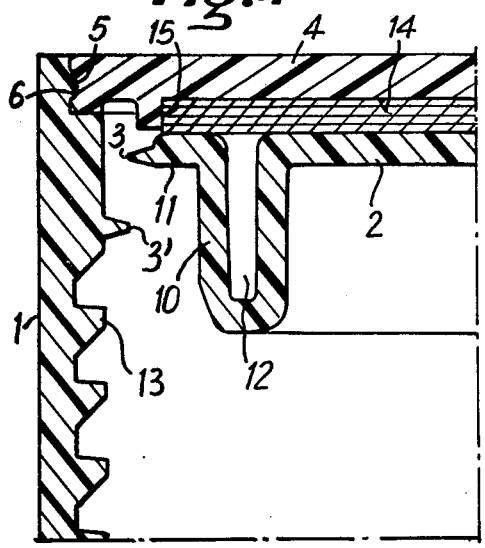
Fig:5
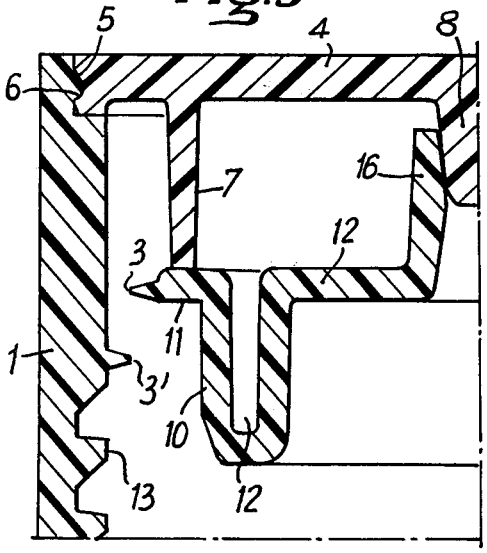
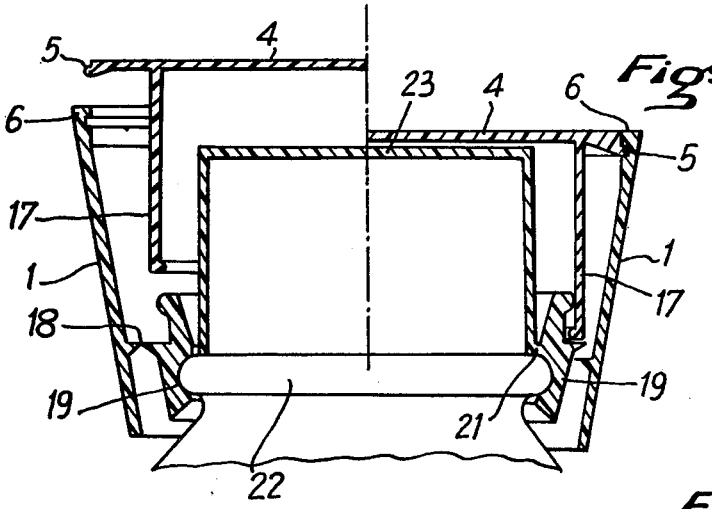
Fig:6
Fig: 7
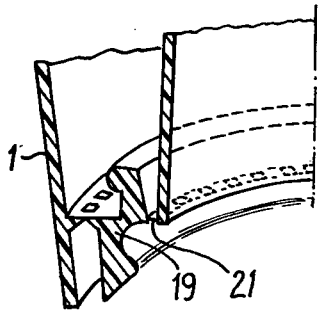
Fig:8
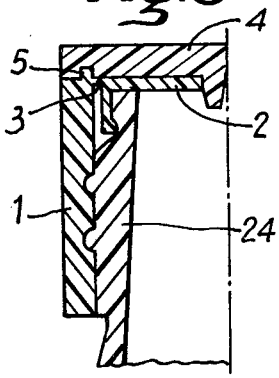
Fig:9
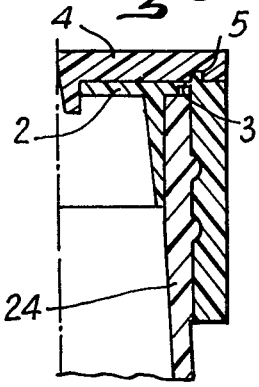

REDUCER-CARRYING CAP

BACKGROUND OF THE INVENTION

The present invention relates to a reducer-carrying cap intended to be placed on the neck of a bottle, pot, drum or other container of this type made from glass, plastics, metal or other materials, so as to seal the container in leaktight manner and then, at the time of use, reduce the flow rate of the liquid contained therein. This cap may also comprise either a cover or a cover and a joint, or a pouring spout which may or may not be tamper-proof or an applicator spout which may or may not be tamper-proof, or any other shaped parts. The invention also relates to a tamper-proof cap for the top of an atomiser bottle.

The caps according to the invention are intended particularly for perfumery products, pharamaceutical, household and industral products, etc.

The devices used at present are made up of the following parts:

(a) a ring of reduced opening surmounted by a sealing cap, (b) or a ring receiving a skirt-type reducer, surmounted by a sealing cap, (c) or a ring receiving a plastic cap with a pouring spout which may or may not be resealable.

In example "b," as the caps and reducers are produced and supplied separately, the fitting of these parts demands a substantial amount of equipment, and incurs high staffing costs, energy and maintenance costs, storage and handling costs. Moreover, the fitting of the reducers slows down the speed of production on the assembly line without guaranteeing that the reducer is properly fitted.

The invention dispenses with or simplifies the above operations and results in an improvement in the rate of assembly line production. A substantial saving is made by using the present invention on a container with a normal-sized opening instead of a narrow-mouthed container, e.g. in the case of a glass bottle.

BRIEF SUMMARY OF THE INVENTION

Accordingly, the invention provides a reducer-carrying cap consisting of a cap member open at the top, which is moulded in one piece with the reducer, the lid plate of the cap either being moulded simultaneously with a hinge oriented at 180° or moulded separately so as to be fixed on the cap member later and possibly welded thereto ultrasonically.

The reducer is integral with the inner wall of the cap member via a series of self-breaking points of attachment.

The lid plate of the cap comprises, at the bottom, reliefs which ensure that a spacing is maintained between it and the upper part of the reducer.

The orifice of the reducer is closed by means of a wedge, reed or skirt in relief placed on the bottom of the lid plate of the cap.

Optionally, a joint is placed between the upper surface of the reducer and the lower surface of the lid plate of the cap.

The orifice of the reducer may be in the form of a pouring spout or applicator.

The self-breaking points of attachment between the cap and the reducer may be placed at a level which ensures that they are broken at the moment when the seal is put on as the neck of the container moves up inside the cap or else at the moment when the cap is opened for use.

Moreover, the level of the points of attachment defines a plate which abuts on the ring of the container, serving as an abutment and end stop. This is to prevent the lid plate or covering cowl from being torn off, as would inevitably occur if the cap did not have this blocking system.

In the case of a tamper-proof cover for the top of an atomiser bottle, the cap member is integral with the crown of the neck via a series of studs which break automatically at the moment of clipping, whilst the lid plate of the cap which forms a cover at the bottom is fixed to the said cap member.

The self-breaking points of attachment placed between the cap member and the reducer have the functions of enabling the reducer to be supplied with plastics during moulding and eventually enabling the two parts to be separated.

When the lid plate of the cap, oriented at 180°, is moulded at the same time as the reducer-carrying cap, the lid plate then merely has to be pushed on to the cap and is ready for mounting on the bottle.

When the lid plate is moulded separately, these lid plates may be mechanically fixed to the cap by means of a machine which orients the cap members with the reducers as they leave the press in order to align them below a lid distributing head, which may itself be provided with an ultrasonic welding unit.

In a variant of the invention, the lid of the cap, which consists of a plate in the above embodiments, is replaced by a covering cowl which covers and fits on the open cap member.

This cowl comprises a sealing skirt which closes off the reducer, the cover, the pouring spout, applicator or other shaped parts.

The inner lateral wall of the covering cowl comprises ribs designed to engage in corresponding ribs formed on the lateral wall of the cap member and an attachment system using a straining cord.

BRIEF DESCRIPTION OF THE DRAWINGS

The following description explains the features of the invention in more detail, with reference to the accompanying drawings, which are given by way of non-restrictive examples.

In the drawings:

FIG. 4 shows a section through a variant of the embodiment in FIG. 3, with a joint placed between the reducer and the cap, FIG. 5 shows a section through an embodiment wherein the reducer comprises a pouring spout or applicator, FIG. 6 shows a section through a tamper-proof top for an aerosol can, the left-hand side showing the parts before attachment, to the cap, of the lid plate which is provided with a cover, whilst the right-hand side shows the parts after attachment of the lid plate.

FIG. 7 is an enlarged view of part of FIG. 6,

FIG. 8 shows a cap with a reducer over it, wherein the level of the points of attachment is positioned so that these points are broken not at the moment when the cap is put on but when the cap is open so that the product can be used, FIG. 9 shows a variant of FIG. 8 wherein the reducer has an inner skirt.

DESCRIPTION OF THE PREFERRED EMBODIMENT

Figure 2:
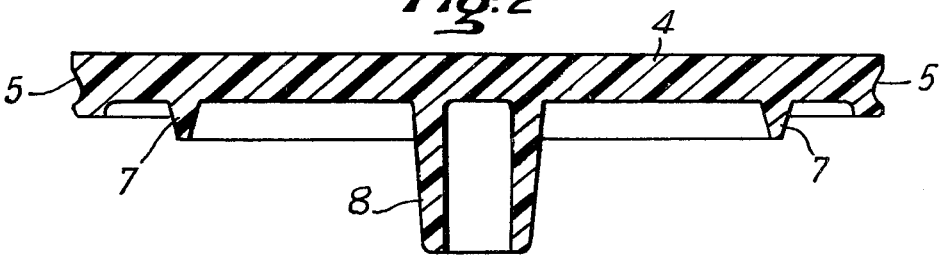
FIG. 2 is a section through the lid plate intended to complete the reducer-carrying cap.
Figure 1:
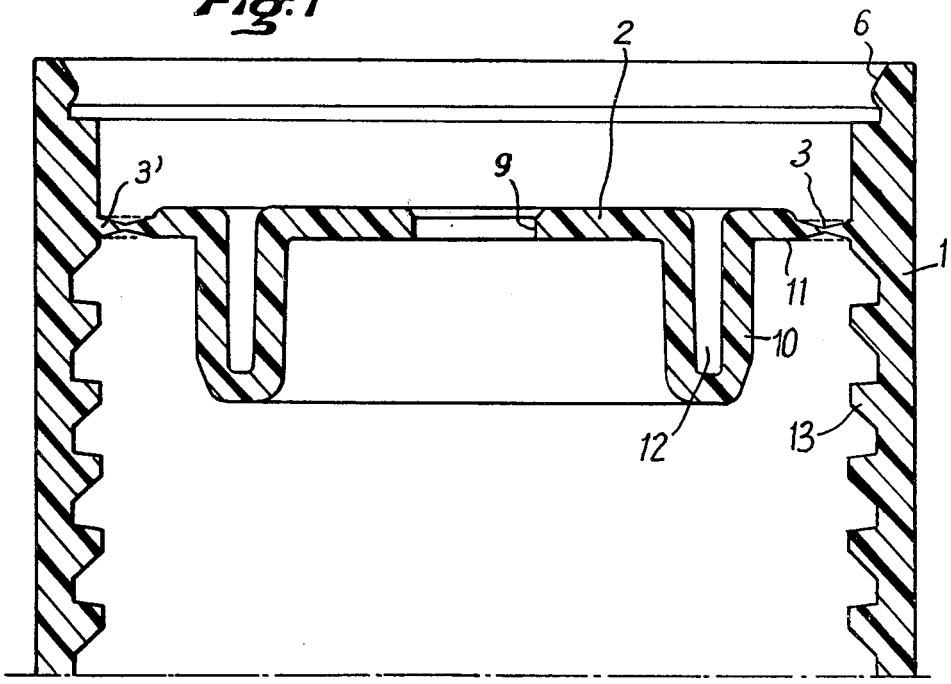
FIG. 1 shows a section through the reducer-carrying cap member obtained by moulding in one piece.
Figure 3:
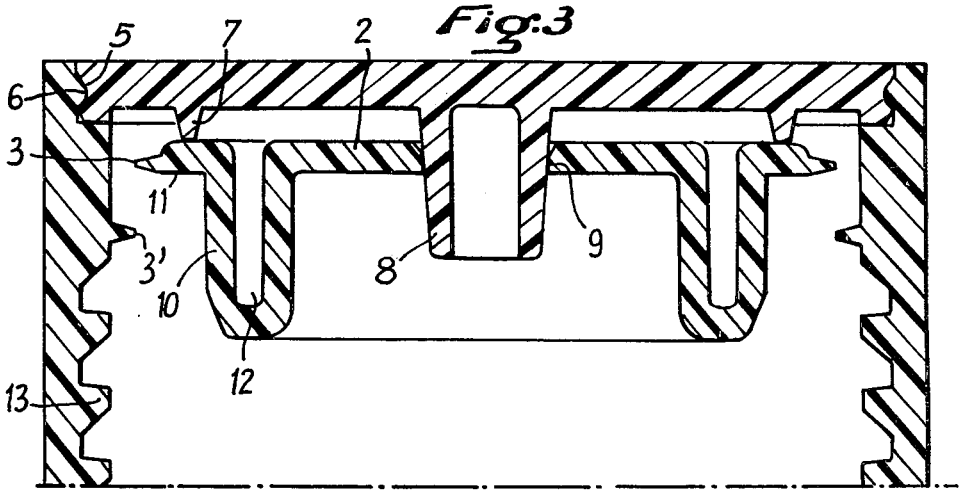
FIG. 3 is a section through the reducer-carrying cap after breakage of the self-breaking points of attachment.

According to FIGS. 1 to 9, the cap 1 contains a reducer 2 which is integral therewith via self-breaking points of attchment 3. The lid plate 4, laterally provided with fixing hollows 5, is intended to complete the reducer-carrying cap, the upper part of which comprises reliefs 6 corresponding to the hollows 5 to enable the lid to clip into place.

The reliefs 7 formed on the lower part of the lid plate 4 are intended to ensure that a spacing is maintained between the latter and the upper part of the reducer 2.

The skirt 8 formed on the lower part of the lid plate 4 is intended to close the orifice 9 of the reducer.

In FIGS. 1, 3, 4 and 5, the reducer has a double skirt 10 with a loop 12 to ensure better sealing of the neck of the bottle by elasticity.

The edge 11 of the reducer surrounds the neck of the bottle (not shown).

After breakage of the points of attachment 3, the plate 3' comes to abut on the neck of the bottle (not shown).

The cap is fixed to the neck by means of a thread 13.

In FIG. 4, a reducer-carrying cap is shown in the closed position with a joint 14 made of any type of material, especially cork, agglovinyl or the like, interposed between the upper part of the reducer 2 and the lower part of the lid plate 4, this joint being laterally gripped by the relief 15.

In FIG. 5, the reducer is provided with a pouring spout 16 sealed off by the skirt 8.

According to FIG. 6, the lid plate 4 comprises in its lower part a skirt 17 which, once attached, comes to abut on the lateral relief of a crown 21 for sealing the orifice 22 of the aerosol can. The studs 18 between the crown 19 and the cap 1 break at the moment of clipping on to the can.

According to FIGS. 8 and 9, the self-breaking points of attachment 3 may be placed level with the closure of the reducer-carrying cap on the neck 24 of the bottle. In this embodiment, the self-breaking points of attachment remain intact in the closed position; they are not broken until the cap is opened by the user.

Figure 10:
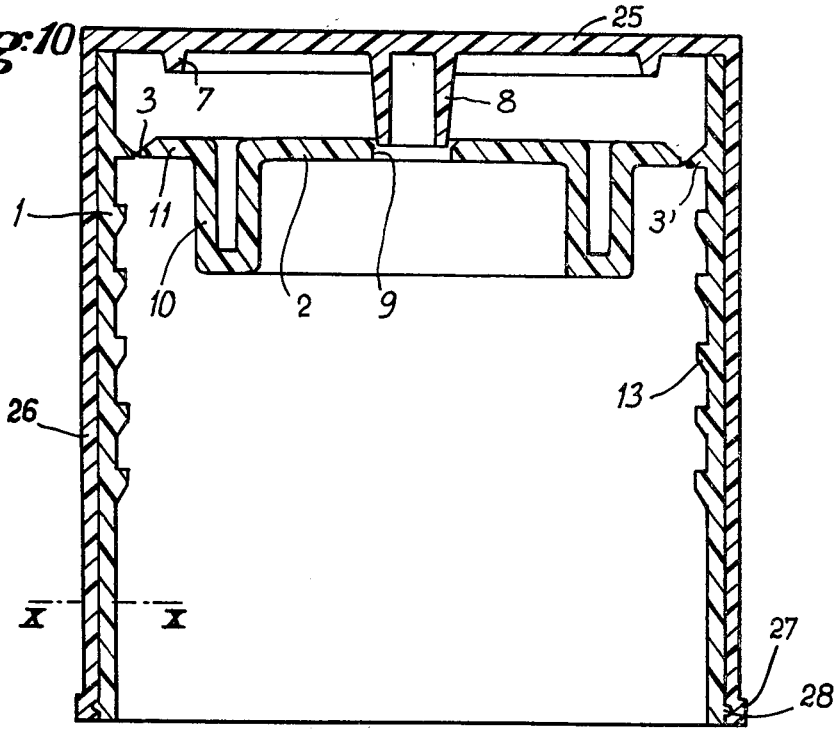
FIG. 10 is a section through a variant wherein the lid is replaced by a covering cowl which totally covers the reducer-carrying cap member.
Figure 11:
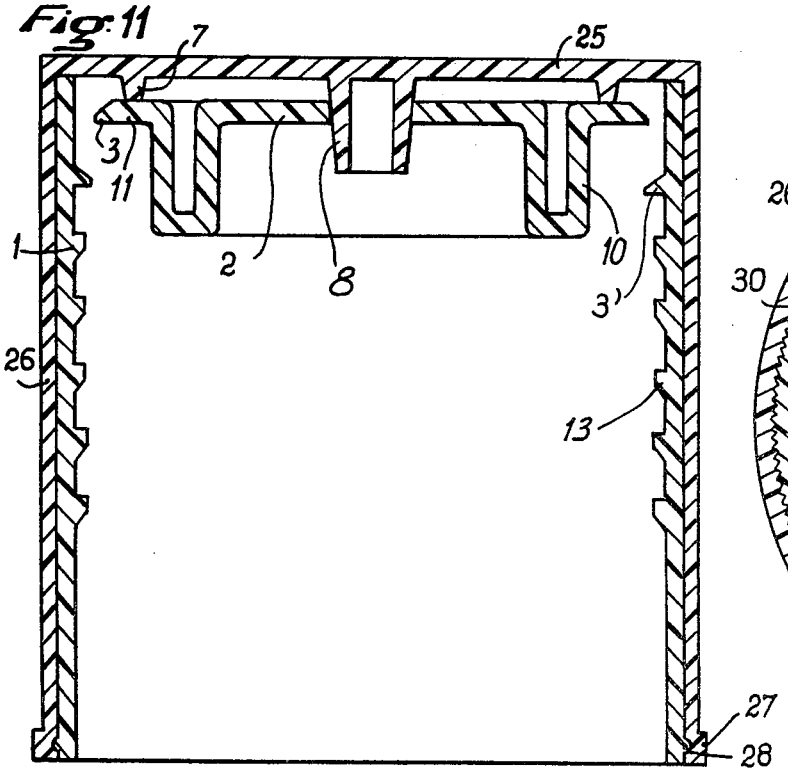
FIG. 11 is a section through the variant in FIG. 10 after breakage of the points of attachment of the reducer-carrier when the latter is engaged in the closed position on the neck of the bottle.
Figure 12:
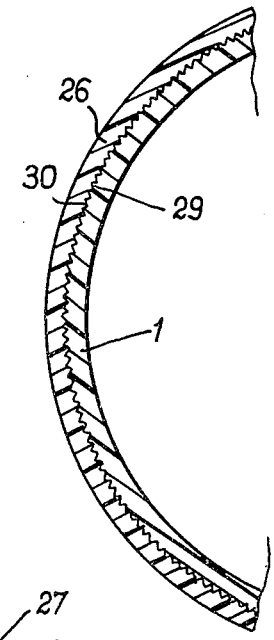
FIG. 12 is a section on the line 10—10 in FIG. 10.

In the variant shown in FIGS. 10, 11 and 12, the reducer-carrying cap, like those described hereinbefore, consists of a cap member 1 open at the top, which is moulded in one piece with the reducer 2. The cap 1 and the reducer 2 are connected by means of self-breaking points of attachment 3. The reducer 2 comprises a double skirt 10 with a rim 11 intended to surround the neck of the bottle (not shown). After the points of attachment 3 are broken, the plate 3' comes to abut on the neck of the bottle (not shown). The cap 1 is fixed to the neck by means of a screw thread 13.

The covering cowl 25 covers the cap member 1 and its lateral wall 26 abuts on the outer lateral wall of the cap member 1.

The inner surface of the wall 26 of the cowl 25 comprises vertical ribs which engage in corresponding ribs on the outer surface of the lateral wall of the cap member 1. Thus, the cowl 25 cannot rotate relative to the cap member.

The lower end 27 of the lateral wall 26 comprises an inner groove intended to engage over an attachment reed 28 formed on the lower part of the lateral wall of the cap member 1. This device prevents the cowl 25 from moving out of engagement vertically relative to the cap member 1.

The engagement of the reducer inside the neck of the bottle determines the breakage of the self-breaking points of attachment 3, as shown in FIG. 2.

The sealing skirt 8, placed inside the cowl 25, engaged in the orifice 9 of the reducer in the closed position on the neck of the bottle.

This embodiment of the invention makes it possible to mount the cowl 25 on the cap member 1 at a fast rate which is further increased by the conicity required for moulding the cap member.

The cowl 25 may be made from any material (especially plastics, metal or glass), i.e. a different material from that used for the cap member 1. The cowl 25 may be of any desired form, so that any aesthetic design is possible.

In all the various embodiments, the reducer, cover, pouring spout, applicator or other parts remain fixed to the neck of the bottle when the cap is removed for use.

The invention applies to all types of stoppers: screw caps, snap-fit or twist-type caps, covers with double skirts of all kinds and lids for wide-mouthed containers.

In the same way it is possible to mould, adjoining the cap, a bowl-type cover for any king of product, or an applicator attachment which has to be cut or is ready for use.

The reducer-carrying cap according to the invention may be made from any thermoplastic material, particularly polypropylene, polyethylene and polystyrene.

In the variant, the cowl on the one hand and the cap on the other hand may be of different colours, so that, if desired, the colour of the reducer may be matched to the colour of the bottle.

The reducer-carrying cap member, cover, cover+-joint, pourer spout, applicator or other parts may be used as a refill to be inserted in any desired type of bottle cover.

Obviously, details of these embodiments may be modified using equivalent technical means, without going beyond the scope of the invention.

I claim:

1. A cover and applicator spout device for attachment to a container for containing a liquid, comprising:

a cap member having inward facing attachment means for engagement with a neck portion of the container, said cap member including a passageway for allowing the flow of the liquid from the container therethrough;

a flow reducer having a central spout opening therethrough, said flow reducer being initially frangibly mounted within said passageway, said flow reducer being attachable to the distal end of the neck portion of container, said spout opening communicating with the interior of the container, said spout opening being of a smaller diameter than the neck portion of the container; and a cover including means for attachment to said cap member, said cover sealingly closing said passageway;

whereby said cap member and said flow reducer may be attached to the container as an integral assembly, whereupon said flow reducer is separated from said cap member and engages the neck portion of the container.

2. A cover and applicator spout device according to claim 1, wherein the separation of the flow reducer from the cap member is carried out by tearing a more brittle area provided at the manufacturing stage between the reducer and the cap member.

3. A cover and applicator spout device, according to claim 1 or 2, wherein said cover consists of a cowl, the sidewall of which abuts the outer lateral wall of the said cap member and includes means for engaging said cap member.

4. A cover and applicator spout device according to claim 3, wherein the outer surface of the lateral wall of the cap member comprises vertical ribs which engage with correspondng ribs formed on the inner surface of the cowl.

5. A cover and applicator spout device according to claim 3, wherein the lower end of the cap member comprises an attachment reed on the outer surface thereof with which an inner groove of the lateral wall of the cowl engages in the closed position.

6. A cover and applicator spout device according to claim 1, wherein said opening of said reducer is in the form of a pouring spout or applicator spout.

7. A cover and applicator spout device according to claim 2, wherein said brittle area between said cap and said reducer are placed such that when the cap member is attached to the container, said reducer is above the upper section of the neck of said container so that it is broken at the moment when the cap is ready for use.

8. A cover and applicator spout device according to claim 1, wherein said opening of said reducer is closed by means of a wedge, reed, or skirt extending from the bottom of said cover.

9. A cover and applicator spout device according to claim 1, wherein a joint is optionally placed between the upper surface of said reducer and the lower surface of said cover.

* * * * *